US009786215B2

(12) United States Patent
Xu

(10) Patent No.: US 9,786,215 B2
(45) Date of Patent: Oct. 10, 2017

(54) DISPLAY PANEL AND DRIVING METHOD THEREOF

(71) Applicant: Shenzhen China Star Optoelectronics Technology Co., Ltd., Shenzhen, Guangdong (CN)

(72) Inventor: Xiangyang Xu, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 14/377,355

(22) PCT Filed: May 15, 2014

(86) PCT No.: PCT/CN2014/077543
§ 371 (c)(1),
(2) Date: Aug. 7, 2014

(87) PCT Pub. No.: WO2015/168959
PCT Pub. Date: Nov. 12, 2015

(65) Prior Publication Data

US 2017/0061854 A1 Mar. 2, 2017

(30) Foreign Application Priority Data

May 9, 2014 (CN) ..... 2014 1 0196235

(51) Int. Cl.
*G09G 3/20* (2006.01)

(52) U.S. Cl.
CPC ..... *G09G 3/2092* (2013.01); *G09G 3/20* (2013.01); *G09G 2300/0426* (2013.01); *G09G 2310/0202* (2013.01); *G09G 2310/0254* (2013.01); *G09G 2310/08* (2013.01); *G09G 2330/021* (2013.01)

(58) Field of Classification Search
CPC ..... G09G 3/2092; G09G 2300/0426; G09G 2310/0202; G09G 2310/0254; G09G 2310/08; G09G 2330/021
See application file for complete search history.

(56) References Cited

U.S. PATENT DOCUMENTS 8,179,350 B2 * 5/2012 Park ..... G02F 1/1368 345/87
2012/0206437 A1 * 8/2012 Kang ..... G09G 3/3614 345/213

* cited by examiner

*Primary Examiner* — Afroza Chowdhury
(74) *Attorney, Agent, or Firm* — Emerson Thomson Bennett, LLC; Roger D. Emerson

(57) ABSTRACT

A display panel and a driving method thereof are provided. The display panel has a clock signal generating module, a scanning signal generating module, a data signal generating module, first and second data lines, and first and second pixel columns. The first data line connects to second and third sets of pixels in the first pixel columns, and the second data line connects to fourth set of pixels in the second pixel columns and the next first set of pixels adjacent thereto. The present invention can reduce the power consumption of the display panel.

7 Claims, 7 Drawing Sheets

301

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| − | + | − | + | − | + | − | + |
| − | + | − | + | − | + | − | + |
| + | − | + | − | + | − | + | − |
| + | − | + | − | + | − | + | − |
| + | − | + | − | + | − | + | − |
| + | − | + | − | + | − | + | − |

302

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| + | − | + | − | + | − | + | − |
| + | − | + | − | + | − | + | − |
| − | + | − | + | − | + | − | + |
| − | + | − | + | − | + | − | + |
| − | + | − | + | − | + | − | + |
| − | + | − | + | − | + | − | + |

FIG.3

Prior Art

DISPLAY PANEL AND DRIVING METHOD THEREOF

This application claims priority under 35 U.S.C. §119 to International Patent Application No. PCT/CN2014/077543 filed on May 15, 2014, which in turn, claims priority to China Patent Application Serial Number 201410196235.2, filed on May 9, 2014, both of which are herein incorporated by reference in their entireties.

FIELD OF THE INVENTION

The present invention relates to a technical field of a display, and more particularly to a display panel and a driving method thereof.

BACKGROUND OF THE INVENTION

Traditional driving methods for display panels comprise Frame Inversion, Column Inversion, Row Inversion, and Dot Inversion.

Referring to FIG. 1, each of the scanning signal lines connects to a pixel located in the same row (e.g. pixel row 103) for the Dot Inversion driving method, and scanning signals are transmitted by each of scanning signal lines for controlling a gate of the pixel connected to the scanning signal line to open or close. Each of data signal lines (e.g. data line 102) connects to a pixel located in the same column (e.g. pixel column 101), and data signals are transmitted by each of the data signal lines for controlling a grayscale voltage of the pixel connected to the data signal line.

An effect of the Dot Inversion of FIG. 3 is executed by using the display panel of FIG. 1, the polarity of the same pixels are opposite in two adjacent images 301, 302, and the polarity of the two adjacent pixels located in the same row are opposite in the same images (e.g. a first image 301 or a second image 302). An appropriate technical scheme is shown in FIG. 2.

A scanning signal (comprising a first scanning signal GA and a second scanning signal GB) opens the gates in every pixel row, the data line provides different data signals to the pixels of different rows in a keeping time of a image.

However, the Applicant has found some problems existing in the actual use of the traditional technology.

The polarity (POL_O) of the data signal needs to change N times in the keeping time of the image (e.g. the keeping time of the first image 201 or the keeping time of the second image), wherein N is greater than 2 for satisfying the requirement that the pixels of different rows correspond to the data signals of different polarities, and the frequency of changing the polarity of the data signal is N times. Thus, the logic power consumption of a traditional display panel is larger.

Therefore, it is necessary to provide another technical solution, in order to solve the problems of the prior art.

SUMMARY OF THE INVENTION

An object of the present invention is to provide a display panel and driving method thereof, which reduces the frequency of changing the polarity of the data signal, so that the logic power consumption of the display panel can be reduced.

To achieve the above object, the present invention provides a technical solution as follows:

A display panel comprising a clock signal generating module for generating a clock signal; a scanning signal generating module for generating a scanning signal according to the clock signal; a data signal generating module for generating a data signal according to the clock signal; and at least two groups of pixel columns arranged in an array, wherein the groups of pixel column comprise a first data line for transmitting the data signal; a second data line for transmitting the data signal; a first pixel column comprises at least one first set of pixels and at least one second set of pixels; a second pixel column comprises at least one third set of pixels and at least one fourth set of pixels; wherein the first pixel column is adjacent to the second pixel column, each of the first, second, third, and fourth sets of pixels comprises at least one pixel, the first data line connects to the second and third sets of pixels, the second data line connects to the fourth set of pixels, and the second data line further connects to the first set of pixels of the next group of pixel column adjacent thereto; wherein the polarities of the two adjacent sets of pixels are opposite each other; wherein the scanning signal includes a first scanning signal for controlling a gate of a first pixel row, and a second scanning signal for controlling a gate of a second pixel row, wherein the first pixel row is one pixel row in the two groups of pixel columns, and the second pixel row is the other pixel row in the two groups of pixel columns adjacent to the first pixel row.

In one embodiment of the display panel, the data signal generating module generates the first and second data signals when the clock signal arrives at a first time, transmits the first data signal to the second and third sets of pixels by the first data line, and transmits the second data signal to the fourth set of pixels and the first set of pixels of the next grouping of pixel columns adjacent thereto by the second data line; wherein the data signal generating module further generates third and fourth data signals when the clock signal arrives at a second time, transmits the third data signal to the second and third sets of pixels by the first data line, and transmits the fourth data signal to the fourth set of pixels and the first set of pixels of the next group of pixel columns adjacent thereto by the second data line; and wherein the first and second times correspond to a starting time and an ending time of one image is displayed on the display panel, respectively.

In one embodiment of the display panel, the polarity of the second data signal is opposite the polarity of the first data signal, the polarity of the third data signal is opposite the polarity of the first data signal, and the polarity of the fourth data signal is opposite the polarity of the second data signal.

In one embodiment of the display panel, the polarities of the first and second data signals are unchanged during a keeping time of the one image from the first time beginning; and the polarities of the third and fourth data signals are unchanged during a keeping time of the one image from the second time beginning.

In one embodiment of the display panel, the clock signal has a first clock signal and a second clock signal, the scanning signal generating module generates the first scanning signal when the first clock signal arrives at a third time, and transmits the first scanning signal to the first pixel row; and the scanning signal generating module further generates the second scanning signal when the second clock signal arrives at a fourth time, and transmits the second scanning signal to the second pixel row.

In one embodiment of the display panel, a cycle time of the first clock signal and a cycle time of the second clock signal comprise four unit times, respectively; and one of the unit times is between a starting time of the first clock signal and a starting time of the second clock signal.

In one embodiment of the display panel, the first scanning signal has a first high level pulse, the second scanning signal has a second high level pulse, a keeping time of the first high level pulse and a keeping time of the second high level pulse are two of the unit times, respectively; wherein a starting time of the first high level pulse corresponds to the third time, and a starting time of the second high level pulse corresponds to the fourth time; and wherein the fourth time is after the third time, and one of the unit times is between the third and fourth times.

A display panel comprises a clock signal generating module for generating a clock signal; a scanning signal generating module for generating a scanning signal according to the clock signal; a data signal generating module for generating a data signal according to the clock signal; and at least two groups of pixel columns arranged in an array, wherein the groups of pixel columns comprise a first data line for transmitting the data signal; a second data line for transmitting the data signal; a first pixel column comprises at least one first set of pixels and at least one second set of pixels; a second pixel column comprises at least one third set of pixels and at least one fourth set of pixels; wherein the first pixel column is adjacent to the second pixel column, each of the first, second, third, and fourth sets of pixels comprises at least one pixel, the first data line connects to the second and third sets of pixels, the second data line connects to the fourth set of pixels, and the second data line further connects to the first set of pixels of the next group of pixel columns adjacent thereto.

In one embodiment of the display panel, the data signal generating module generates the first and second data signals when the clock signal arrives at a first time, transmits the first data signal to the second and third sets of pixels by the first data line, and transmits the second data signal to the fourth set of pixels and the next first set of pixels adjacent thereto by the second data line; wherein the data signal generating module further generates the third and fourth data signals when the clock signal arrives at the second time, transmits the third data signal to the second and third sets of pixels by the first data line, and transmits the fourth data signal to the fourth set of pixels and the next first set of pixels adjacent thereto by the second data line; wherein the first and second times correspond to a starting time and a ending time of one image displayed on the display panel, respectively.

In one embodiment of the display panel, the polarity of the second data signal is opposite the polarity of the first data signal, the polarity of the third data signal is opposite the polarity of the first data signal, and the polarity of the fourth data signal is opposite the polarity of the second data signal.

In one embodiment of the display panel, the polarities of the first and second data signals are unchanged during a keeping time of the one image from the first time beginning; and the polarities of the third and fourth data signals are unchanged during the keeping time of the one image from the second time beginning.

In one embodiment of the display panel, the scanning signal includes a first scanning signal for controlling a gate of a first pixel row, and a second scanning signal for controlling a gate of a second pixel row, wherein the first pixel row is one pixel row in the two groups of pixel columns, and the second pixel row is the other pixel row in the two groups of pixel columns adjacent to the first pixel row.

In one embodiment of the display panel, the scanning signal includes a first scanning signal for controlling a gate of a first pixel row, and a second scanning signal for controlling a gate of a second pixel row, wherein the first pixel row is one pixel row in the two groups of pixel columns, and the second pixel row is the other pixel row in the two groups of pixel columns adjacent to the first pixel row.

In one embodiment of the display panel, the clock signal has a first clock signal and a second clock signal. The scanning signal generating module generates the first scanning signal when the first clock signal arrives at a third time, and transmits the first scanning signal to the first pixel row; and the scanning signal generating module further generates the second scanning signal when the second clock signal arrives at a fourth time, and transmits the second scanning signal to the second pixel row.

In one embodiment of the display panel, a cycle time of the first clock signal and a cycle time of the second clock signal comprise four unit times, respectively; and one of the unit times is between a starting time of the first clock signal and a starting time of the second clock signal.

In one embodiment of the display panel, the first scanning signal has a first high level pulse, the second scanning signal has a second high level pulse, a keeping time of the first high level pulse and a keeping time of the second high level pulse are two of the unit times, respectively; wherein a starting time of the first high level pulse corresponds to the third time, and a starting time of the second high level pulse corresponds to the fourth time; and wherein the fourth time is after the third time, and one of the unit times is between the third and fourth times.

A driving method for said display panel, the method comprises the steps of: generating the clock signal by the clock signal generating module; generating the first and second data signals by the data signal generating module when the clock signal arrives at a first time, then transmitting the first data signal to the second and third sets of pixels by the first data line, and transmitting the second data signal to the fourth set of pixels and the first set of pixels of the next group of pixel columns adjacent thereto by the second data line; generating the third and fourth data signals by the data signal generating module when the clock signal arrives at a second time, then transmitting the third data signal to the second and third sets of pixels by the first data line, and transmitting the fourth data signal to the fourth set of pixels and the first set of pixels of the next group of pixel columns adjacent thereto by the second data line.

In one embodiment of the driving method, the polarity of the second data signal is opposite the polarity of the first data signal, and the polarities of the first and second data signals are unchanged during a keeping time of one image from the first time beginning; wherein the polarity of the third data signal is opposite the polarity of the first data signal, the polarity of the fourth data signal is opposite the polarity of the second data signal, and the polarities of the third and fourth data signals are unchanged during a keeping time of the one image from the second time beginning; and wherein the first and second times correspond to a starting time and a ending time of the one image displayed on the display panel.

In one embodiment of the driving method, the clock signal has a first clock signal and a second clock signal. The driving method further comprises the steps of: generating the first scanning signal by the scanning signal generating module when the first clock signal arrives at a third time, and then transmitting the first scanning signal to the first pixel row; and further generating the second scanning signal by the scanning signal generating module when the second clock signal arrives at a fourth time, and then transmitting the second scanning signal to the second pixel row.

In one embodiment of the driving method, the first clock signal corresponds to the first pixel row, and the second clock signal corresponds to the second pixel row; a cycle time of the first clock signal and a cycle time of the second clock signal comprise four unit times, respectively; wherein one of the unit times is between a starting time of the first clock signal and a starting time of the second clock signal.

In one embodiment of the driving method, the first scanning signal has a first high level pulse, the second scanning signal has a second high level pulse, and a keeping times of the first high level pulse and a keeping time of the second high level pulse are two of the unit times, respectively; wherein a starting time of the first high level pulse corresponds to the third time, and a starting time of the second high level pulse corresponds to the fourth time; and wherein the fourth time is after the third time, and one of the unit times is between the third and fourth times.

Compared to the prior art, the display panel and driving method thereof of the present invention can reduce the frequency of changing the polarity of the data signal, so that the logic power consumption of the display panel can be reduced.

The above-mentioned content of the present invention can be best understood by referring to the following detailed description of the preferred embodiments and the accompanying drawings.

DESCRIPTION OF THE DRAWINGS

FIG. 3 is a schematic view of the polarity of the pixel of the display panel in FIG. 1;

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, the directional terms described by the present invention, such as upper, lower, front, back, left, right, inner, outer, side, longitudinal/vertical, transverse/horizontal, and etc., are only directions by referring to the accompanying drawings, and thus the used directional terms are used to describe and understand the present invention, but the present invention is not limited thereto.

The term (high level pulse) means the part between the rising and the falling in the pulse of the signal.

The term (pixel row) means the set of the pixels in the same row in the pixel array, e.g. first pixel row 404 and second pixel row 405.

The term (pixel column) means the set of the pixels in the same column in the pixel array, e.g. first pixel column 4061 and second pixel column 4063.

Figure 1:
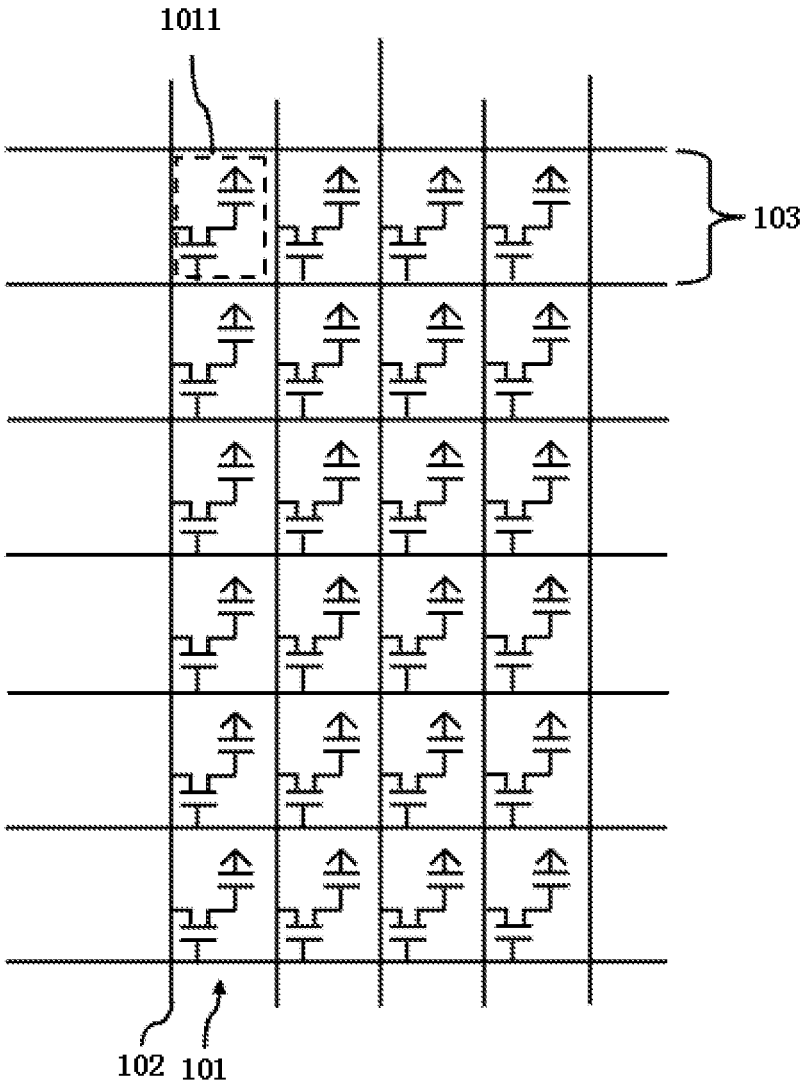
FIG.1 Prior Art
FIG. 1 is a schematic view of the connection between the pixel and the data line in a traditional display panel.
Figure 2:
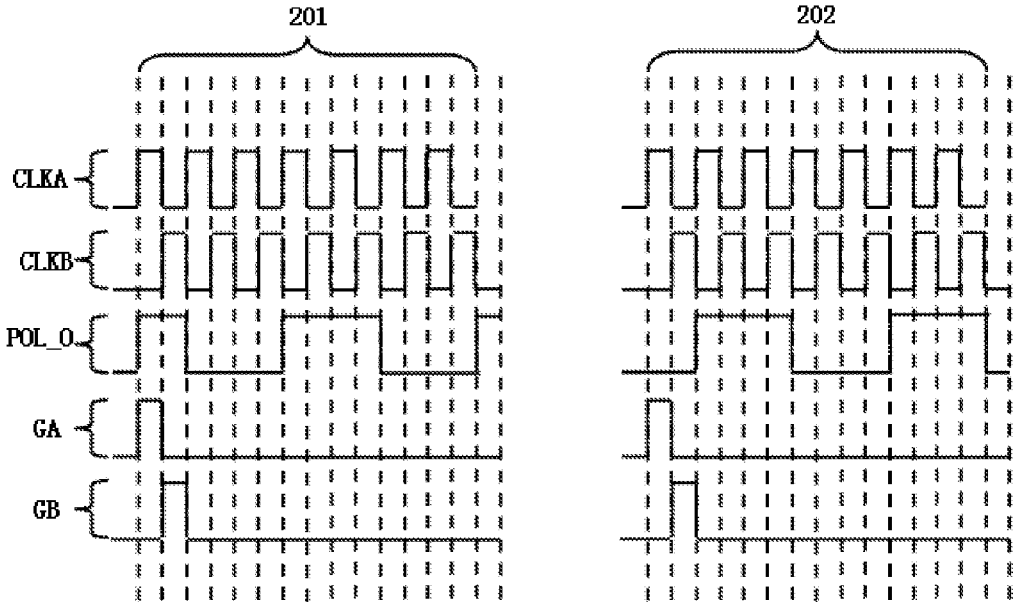
FIG.2 Prior Art
FIG. 2 is a schematic view of a signal of the display panel in FIG. 1.
Figure 4:
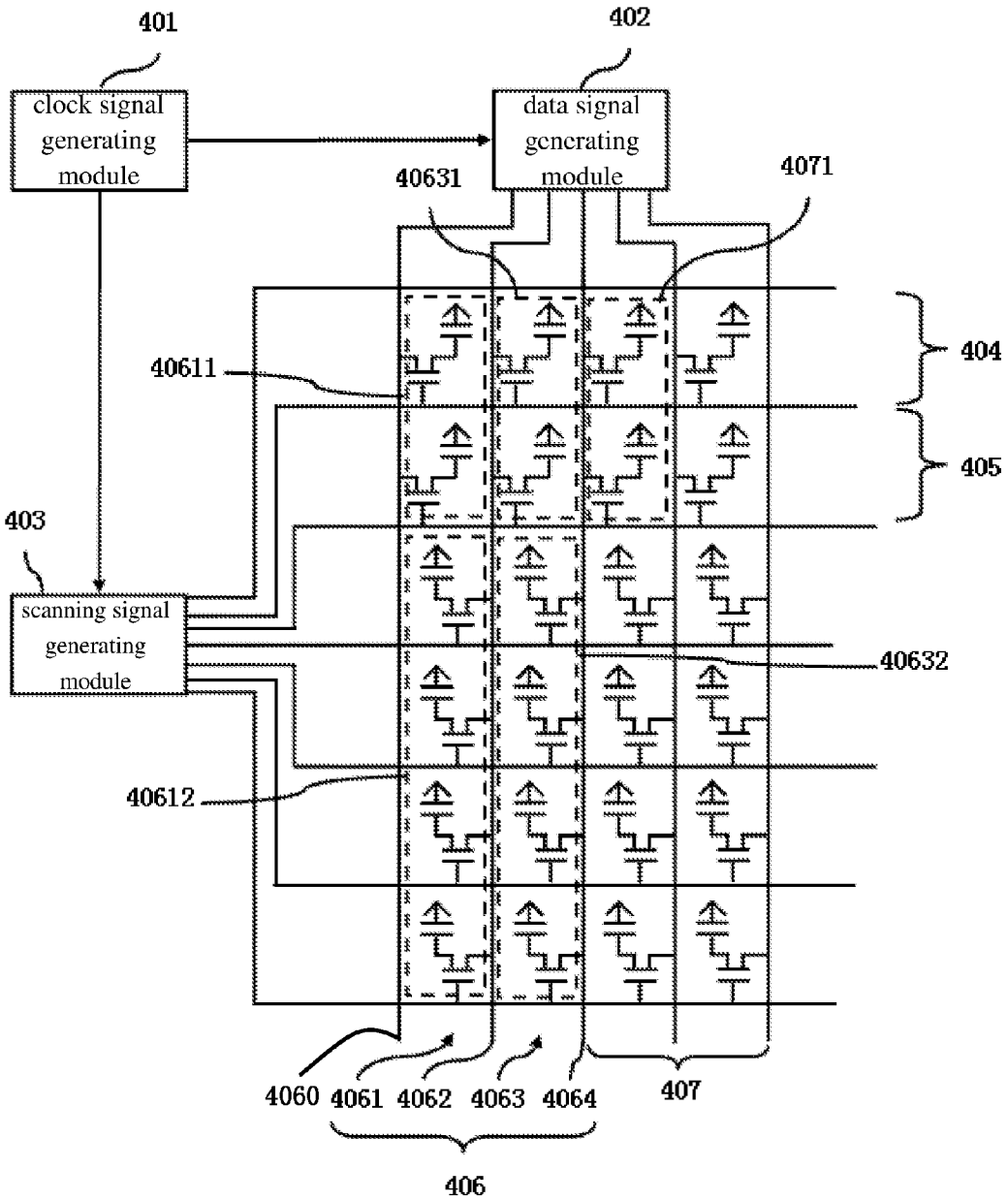
FIG. 4 is a schematic view of the display panel according to the first embodiment of the present invention.
Figure 5:
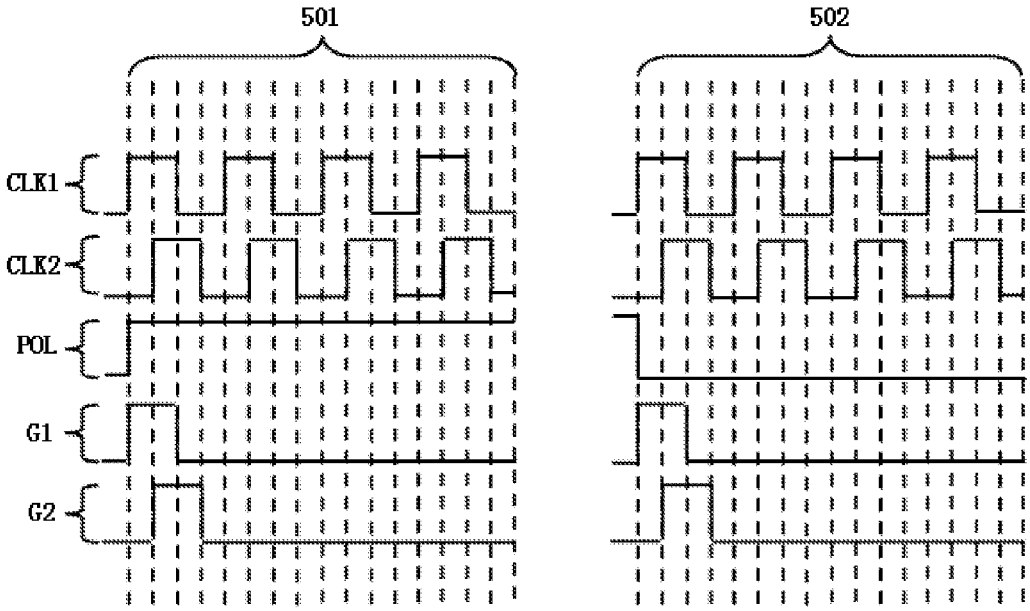
FIG. 5 is a schematic view of a signal of the display panel in FIG. 4.

Referring to FIGS. 4 and 5, FIG. 4 is a schematic view of the display panel according to a first embodiment of the present invention, and FIG. 5 is a schematic view of a signal of the display panel in the FIG. 4.

The display panel of the embodiment comprises a clock signal generating module 401 for generating a clock signal, a scanning signal generating module 403 for generating a scanning signal according to the clock signal, a data signal generating module 402 for generating a data signal according to the clock signal and at least two groups of pixel columns 406, 407 arranged in an array. The data signal generating module 402 connects to the data line, the scanning signal generating module 403 connects to scanning line, the clock signal generating module 401 connects to the data signal generating module 402 and the scanning signal generating module 403.

The groups of pixel column 406 comprise a left data line 4060 for transmitting the data signal, a first data line 4062 interval disposing with the left data line 4060 for transmitting the data signal, a second data line 4064 interval disposing with the first data line 4062 for transmitting the data signal, a first pixel column 4061, and a second pixel column 4063, wherein the first pixel column 4061 and the second pixel column 4063 are arranged side by side, the first pixel column 4061 comprises at least one first set of pixels 40611 and at least one second set of pixels 40612, and the second pixel column 4063 comprises at least one third set of pixels 40631 and at least one fourth set of pixels 40632. The first set of pixels 40611 and the second set of pixels 40612 are arranged and parallel with the first data line 4062, and the third set of pixels 40631 and the fourth set of pixels 40632 are arranged and parallel with the second data line 4064.

The first pixel column 4061 is adjacent to the second pixel column 4063, and each of the first, second, third and fourth sets of pixels 40611, 40612, 40631, 40632 comprises at least one pixel. All of the pixels in the same set of pixels are displayed the image of the same polarity in a keeping time of the one image (e.g. the keeping time of the first image 501 or the keeping time of the second image 502). For example, all of the pixels in the first set of pixels 40611 are displayed at the same polarity (e.g. anode), and all of the pixels in the second set of pixels 40612 are displayed at the same polarity (e.g. cathode). Furthermore, the polarities of the two adjacent sets of pixels (e.g. the first set of pixels 40611 and the second set of pixels 40612) are opposite each other in the same pixel column (e.g. the first pixel column 4061), so that each of the pixels in the first set of pixels 40611 are opposite each of the pixels in the second set of pixels 40612.

In the embodiment, each of the first, second, third, and fourth sets of pixels 40611, 40612, 40631, 40632 comprises any number of pixels. For example, referring to FIG. 4, Dot Inversion 2+4, the first set of pixels 40611 comprises two pixels, the second set of pixels 40612 comprises four pixels, the third set of pixels 40631 comprises two pixels, and the fourth set of pixels 40632 comprises four pixels in the embodiment.

The first data line 4062 connects to the second set of pixels 40612 and the third set of pixels 40631, the second data line 4064 connects to the fourth set of pixels 40632, and the second data line 4064 further connects to the first set of pixels 4071 of the next group of pixel columns 407 adjacent thereto. Therefore, the pixels connected to the first data line 4062 are distributed between the two adjacent pixel columns, and the pixels connected to the second data line 4064 are also distributed between the two adjacent pixel columns.

In the display panel of the present invention, the polarity (POL_O) of the data signal needs to change one time in the keeping time of the image (e.g. the keeping time of the first image 501 or the keeping time of the second image 502) for executing the effect of Dot Inversion. Referring to FIG. 3, the frequency (reverse frequency) of changing the polarity of the data signal generated from the data signal generating module 402 is one time (frame frequency), and the reason is that each of the data lines connects at the same polarity. Compared to the prior art, the display panel of the present invention can reduce the frequency of changing the polarity of the data signal, so that the logic power consumption of the display panel can be reduced.

In the display panel of the embodiment, the clock signal has a clock signal pulse in a cycle time of the clock signal, and the data signal has a data signal pulse in a cycle time of the data signal. The data signal generating module 402 generates the first and second data signals when the clock signal arrives at a first time, transmits the first data signal to the second and third sets of pixels 40612, 40631 by the first data line 4062, and transmits the second data signal to the fourth set of pixels and the first set of pixels 4071 of the next group of pixel columns 407 adjacent thereto by the second data line 4064.

The data signal generating module 402 further generates the third and fourth data signals when the clock signal arrives at the second time, transmits the third data signal to the second and third sets of pixels 40612, 40631 by the first data line 4062, and transmits the fourth data signal to the fourth set of pixels and the first set of pixels 4071 of the next group of pixel columns 407 adjacent thereto by the second data line 4064.

The first and second times correspond to a starting time and an ending time of one image displayed on the display panel, respectively.

In the display panel of the embodiment, the polarity of the second data signal is opposite the polarity of the first data signal, the polarity of the third data signal is opposite the polarity of the first data signal, and the polarity of the fourth data signal is opposite the polarity of the second data signal.

Each of the first and second data signals is the signal in the keeping time of the one image (the keeping time of the first image 501), and each of the third and fourth data signals is the signal in the keeping time of the next image (the keeping time of the second image 502). The polarities of the first and second data signals are unchanged during a keeping time of the one image (the keeping time of the first image 501) from the first time beginning, and the polarities of the third and fourth data signals are unchanged during a keeping time of the one image (the keeping time of the second image 502) from the second time beginning.

The difference between a second embodiment of the display panel of the present invention and the first embodiment is that in the display panel of the second embodiment, the clock signal has a first clock signal CLK1 and a second clock signal CLK2.

The scanning signal comprises a first scanning signal G1 for controlling a gate of a first pixel row 404, and a second scanning signal G2 for controlling a gate of a second pixel row 405, wherein the first pixel row 404 is one pixel row in the two groups of pixel columns 406, 407, and the second pixel row 405 is the other pixel row in the two groups of pixel columns 406, 407 adjacent to the first pixel row 404.

The scanning signal generating module 403 generates the first scanning signal G1 when the first clock signal CLK1 arrives at a third time, and then transmits the first scanning signal G1 to the first pixel row 404.

The scanning signal generating module 403 further generates the second scanning signal G2 when the second clock signal CLK2 arrives at a fourth time, and then transmits the second scanning signal G2 to the second pixel row 405.

Each of the first and second scanning signals G1, G2 has a scanning signal pulse in a scanning signal cycle.

In the display panel of the embodiment, the first clock signal CLK1 corresponds to the first pixel row 404, and the second clock signal CLK2 corresponds to the second pixel row 405.

A cycle time of the first clock signal CLK1 and a cycle time of the second clock signal CLK2 comprise four unit times, respectively.

One of the unit times is between a starting time of the first clock signal CLK1 and a starting time of the second clock signal CLK2, and an overlap time of the high level pulse of the first clock signal CLK1 and the second clock signal CLK2 is one of the unit times.

In the display panel of the embodiment, the first scanning signal G1 has a first high level pulse, the second scanning signal G2 has a second high level pulse, a keeping time of the first high level pulse and a keeping time of the second high level pulse are two of the unit times, respectively.

A starting time of the first high level pulse corresponds to the third time, and a starting time of the second high level pulse corresponds to the fourth time.

Furthermore, the fourth time is after the third time, and one of the unit times is between the third and fourth times. Therefore, an overlap time of the high level pulse of the first scanning signal G1 and the second scanning signal G2 is one of the unit times. The third time and the fourth time are programmed in the keeping time of the one image (the keeping time of the second image 502).

In the display panel of the embodiment, the frequency of changing the polarity of the data signal (the first and second data signal) is the frame frequency. The data line (the first and second data lines 4062, 4064) transmits the signal of the same polarity in the keeping time of the one image. One half row scanning cycle (one of the unit times) is overlapped between the signals of the two adjacent pixel rows (e.g. the first and second scanning signal G1, G2). Thus, the charging of the pixel (pre-charging) can be improved in the pixel row, and the response speed and quality of the display can be improved.

Figure 6:
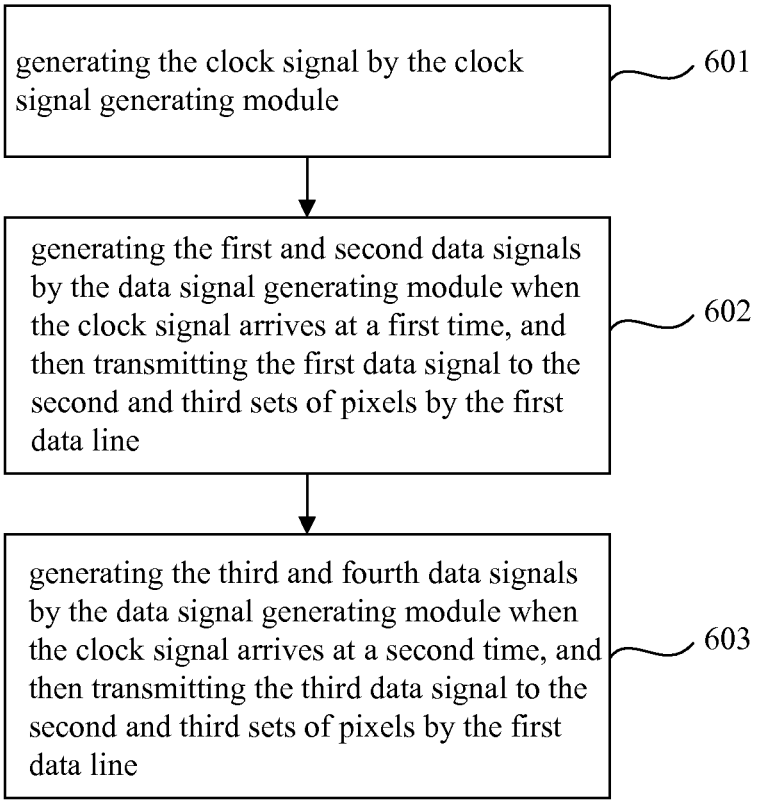
FIG. 6 is a flowchart of a driving method of the display panel according to the first embodiment of the present invention.

FIG. 6 is a flowchart of a driving method of the display panel according to the first embodiment of the present invention. The driving method of the display panel of the embodiment is applied to the above display panel, wherein the driving method of the display panel of the embodiment comprises the steps of:

In a step 601, the clock signal generating module 401 generates the clock signal. The clock signal has a clock signal pulse in a cycle time of the clock signal.

In a step 602, the data signal generating module 402 generates the first and second data signals when the clock signal arrives at a first time, then transmits the first data signal to the second and third sets of pixels 40612, 40631 by the first data line 4062, and transmits the second data signal to the fourth set of pixels and the first set of pixels 4071 of the next group of pixel columns 407 adjacent thereto by the second data line 4064. Each of the first and second data signals has a data signal pulse in a cycle time of the data signal.

In a step 603, the data signal generating module 402 generates the third and fourth data signals when the clock signal arrives at a second time, then transmits the third data signal to the second and third sets of pixels 40612, 40631 by the first data line 4062, and transmits the fourth data signal to the fourth set of pixels and the first set of pixels 4071 of the next group of pixel column 407 adjacent thereto by the second data line 4064.

Furthermore, the polarity of the second data signal is opposite the polarity of the first data signal, and the polarities of the first and second data signals are unchanged during a keeping time of the one image (the keeping time of the first image 501) from the first time beginning.

The polarity of the third data signal is opposite the polarity of the first data signal, and the polarity of the fourth data signal is opposite the polarity of the second data signal. The polarities of the third and fourth data signals are unchanged during a keeping time of the one image (the keeping time of the second image 502) from the second time beginning.

The first and second times correspond to a starting time and an ending time of one image displayed on the display panel, respectively.

All of the pixels in the same set of pixels are displayed the image of the same polarity in a keeping time of the one image. For example, all of the pixels in the first set of pixels 40611 are displayed at the same polarity (e.g. anode), and all of the pixels in the second set of pixels 40612 are displayed at the same polarity (e.g. cathode). The polarities of the two adjacent sets of pixels (e.g. the first set of pixels 40611 and the second set of pixels 40612) are opposite each other in the same pixel column (e.g. the first pixel column 4061), so that each of the pixels in the first set of pixels 40611 are opposite each of the pixels in the second set of pixels 40612.

The polarity of the data signal needs to change one time in the keeping time of the image for executing the effect of Dot Inversion. Referring to FIG. 3, the frequency (reverse frequency) of changing the polarity of the data signal generated from the data signal generating module 402 is one time (frame frequency), and the reason is that each of the data lines connects the same polarity. Compared to the prior art, the display panel of the present invention can reduce the frequency of changing the polarity of the data signal, so that the logic power consumption of the display panel can be reduced.

Figure 7:
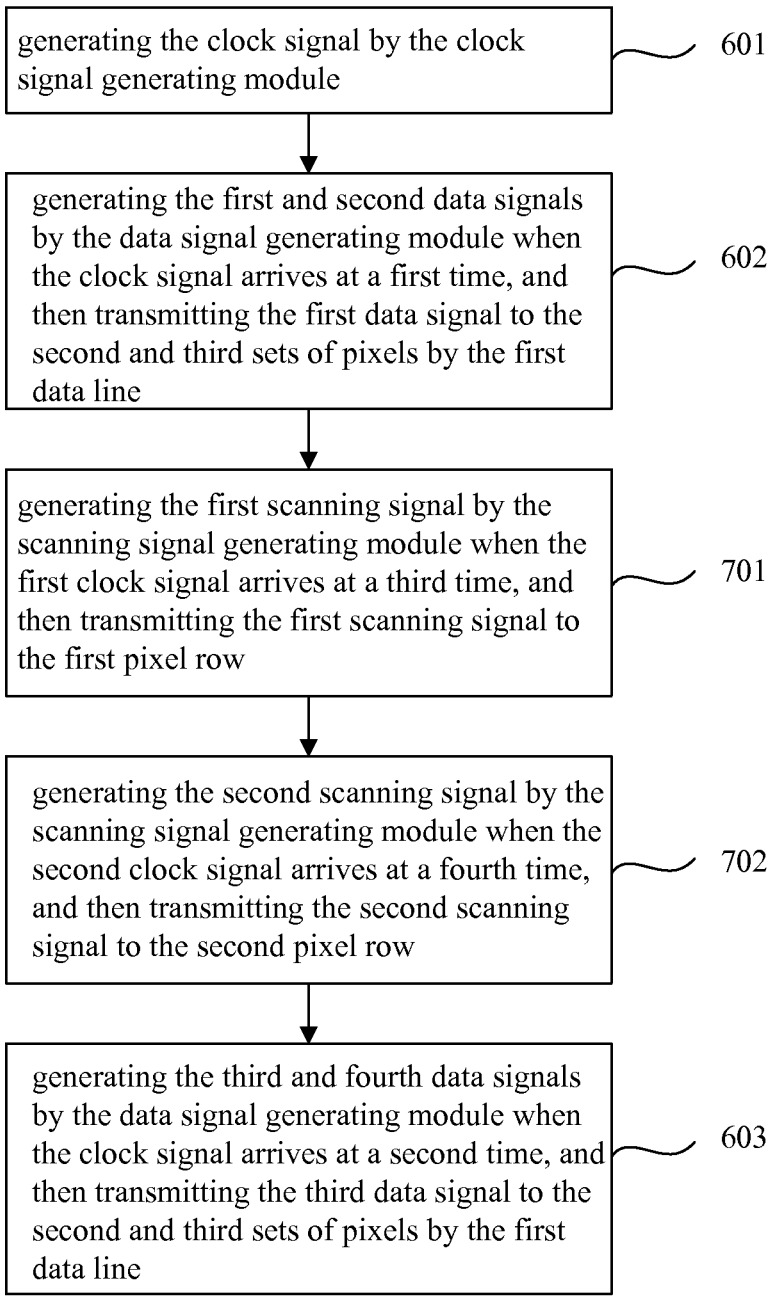
FIG. 7 is a flowchart of a driving method of the display panel according to the second embodiment of the present invention.

FIG. 7 is a flowchart of a driving method of the display panel according to a second embodiment of the present invention. The difference between the second embodiment and the first embodiment is that: in the driving method of the display panel of the second embodiment, the clock signal has a first clock signal CLK1 and a second clock signal CLK2.

The driving method further comprises two additional steps of:

In a step 701, the scanning signal generating module 403 generates the first scanning signal G1 when the first clock signal CLK1 arrives at the third time, and then transmits the first scanning signal G1 to the first pixel row 404.

In a step 702, the scanning signal generating module 403 generates the second scanning signal G2 when the second clock signal CLK2 arrives at the fourth time, and then transmits the second scanning signal G2 to the second pixel row 405.

Each of the first and second scanning signals G1, G2 has a scanning signal pulse in a scanning signal cycle.

In the driving method of the display panel of the embodiment, the first clock signal CLK1 corresponds to the first pixel row 404, and the second clock signal CLK2 corresponds to the second pixel row 405.

A cycle time of the first clock signal CLK1 and a cycle time of the second clock signal CLK2 comprise four unit times, respectively.

One of the unit times is between a starting time of the first clock signal CLK1 and a starting time of the second clock signal CLK2.

In the driving method of the display panel of the embodiment, the first scanning signal G1 has a first high level pulse, the second scanning signal G2 has a second high level pulse, and a keeping time of the first high level pulse and a keeping time of the second high level pulse are two of the unit times, respectively.

Furthermore, a starting time of the first high level pulse corresponds to the third time, and a starting time of the second high level pulse corresponds to the fourth time.

Moreover, the fourth time is after the third time, and one of the unit times is between the third and fourth times.

The third time and the fourth time are programmed in the keeping time of the one image (the keeping time of the second image 502).

In the embodiment, the frequency of changing the polarity of the data signal (the first and second data signal) is the frame frequency. The data line (the first and second data lines 4062, 4064) transmits the signal of the same polarity in the keeping time of the one image. One half row scanning cycle (one of the unit times) is overlapped between the signals of the two adjacent pixel rows (e.g. the first and second scanning signal G1, G2). Thus, the charging of the pixel (pre-charging) can be improved in the pixel row, and the response speed and quality of the display can be improved.

The present invention has been described with a preferred embodiment thereof and it is understood that many changes and modifications to the described embodiment can be carried out without departing from the scope and the spirit of the invention that is intended to be limited only by the appended claims

What is claimed is:

1. A display panel, comprising:

a clock signal generating module for generating a clock signal;

a scanning signal generating module for generating a scanning signal according to the clock signal;

a data signal generating module for generating a data signal according to the clock signal; and at least two groups of pixel columns arranged in an array, the groups of pixel column comprising:

a left data line for transmitting the data signal;

a first data line interval disposing with the left data line for transmitting the data signal;

a second data line interval disposing with the first data line for transmitting the data signal;

a first pixel column comprising at least one first set of pixels and at least one second set of pixels;

a second pixel column comprising at least one third set of pixels and at least one fourth set of pixels;

wherein the first pixel column is adjacent to the second pixel column, each of the first set of pixels, the second set of pixels, the third set of pixels, and the fourth set of pixels comprises at least one pixel, the left data line connects to the first set of pixels, the first data line connects to the second set of pixels and the third set of pixels, the second data line connects to the fourth set of pixels, and the second data line further connects to a first set of pixels of the next group of pixel columns adjacent thereto;

wherein the data signal generating module connects to the data line, the scanning signal generating module connects to a scanning line, and the clock signal generating module connects to the data signal generating module and the scanning signal generating module;

wherein the polarities of the two adjacent sets of pixels are opposite each other;

wherein the scanning signal includes: a first scanning signal for controlling a gate of a first pixel row, and a second scanning signal for controlling a gate of a second pixel row, wherein the first pixel row is one pixel row in the two groups of pixel columns, and the second pixel row is the other pixel row in the two groups of pixel columns adjacent to the first pixel row;

wherein the clock signal has a first clock signal and a second clock signal, the scanning signal generating module generates the first scanning signal when the first clock signal arrives at a third time, and transmits the first scanning signal to the first pixel row; and the scanning signal generating module further generates the second scanning signal when the second clock signal arrives at a fourth time, and transmits the second scanning signal to the second pixel row;

wherein a cycle time of the first clock signal and a cycle time of the second clock signal comprise four unit times, respectively; and one of the unit times is between a starting time of the first clock signal and a starting time of the second clock signal.

2. The display panel according to claim 1, wherein the data signal generating module generates the first and second data signals when the clock signal arrives at a first time, transmits the first data signal to the second and third sets of pixels by the first data line, and transmits the second data signal to the fourth set of pixels and the first set of pixels of the next grouping of pixel columns adjacent thereto by the second data line;

wherein the data signal generating module further generates third and fourth data signals when the clock signal arrives at a second time, transmits the third data signal to the second and third sets of pixels by the first data line, and transmits the fourth data signal to the fourth set of pixels and the first set of pixels of the next group of pixel columns adjacent thereto by the second data line; and wherein the first and second times correspond to a starting time and a ending time of one image displayed on the display panel, respectively.

3. The display panel according to claim 2, wherein the polarity of the second data signal is opposite the polarity of the first data signal, the polarity of the third data signal is opposite the polarity of the first data signal, and the polarity of the fourth data signal is opposite the polarity of the second data signal.

4. The display panel according to claim 3, wherein the polarities of the first and second data signals are unchanged during a keeping time of the one image from the first time beginning; and the polarities of the third and fourth data signals are unchanged during a keeping time of the one image from the second time beginning.

5. The display panel according to claim 1, wherein the first scanning signal has a first high level pulse, the second scanning signal has a second high level pulse, a keeping time of the first high level pulse and a keeping time of the second high level pulse are two of the unit times, respectively; wherein a starting time of the first high level pulse corresponds to the third time, and a starting time of the second high level pulse corresponds to the fourth time; and wherein the fourth time is after the third time, and one of the unit times is between the third and fourth times.

6. A driving method for a display panel, comprising steps of:

generating the clock signal by the clock signal generating module;

generating the first and second data signals by the data signal generating module when the clock signal arrives at a first time, then transmitting the first data signal to the second and third sets of pixels by the first data line, and transmitting the second data signal to the fourth set of pixels and the first set of pixels of the next group of pixel columns adjacent thereto by the second data line;

generating the third and fourth data signals by the data signal generating module when the clock signal arrives at a second time, then transmitting the third data signal to the second and third sets of pixels by the first data line, and transmitting the fourth data signal to the fourth set of pixels and the first set of pixels of the next group of pixel columns adjacent thereto by the second data line;

wherein the polarity of the second data signal is opposite the polarity of the first data signal, and the polarities of the first and second data signals are unchanged during a keeping time of one image from the first time beginning;

wherein the polarity of the third data signal is opposite the polarity of the first data signal, the polarity of the fourth data signal is opposite the polarity of the second data signal, and the polarities of the third and fourth data signals are unchanged during a keeping time of the one image from the second time beginning;

wherein the first and second times correspond to a starting time and an ending time of the one image displayed on the display panel;

wherein the clock signal has a first clock signal and a second clock signal;

the driving method further comprises steps of:

generating the first scanning signal by the scanning signal generating module when the first clock signal arrives at a third time, and then transmitting the first scanning signal to the first pixel row; and further generating the second scanning signal by the scanning signal generating module when the second clock signal arrives at a fourth time, and then transmitting the second scanning signal to the second pixel row;

wherein the first clock signal corresponds to the first pixel row, and the second clock signal corresponds to the second pixel row;

a cycle time of the first clock signal and a cycle time of the second clock signal comprise four unit times, respectively;

wherein one of the unit times is between a starting time of the first clock signal and a starting time of the second clock signal.

7. The driving method for the display panel according to claim 6, wherein the first scanning signal has a first high level pulse, the second scanning signal has a second high level pulse, and a keeping time of the first high level pulse and a keeping time of the second high level pulse are two of the unit times, respectively;

wherein a starting time of the first high level pulse corresponds to the third time, and a starting time of the second high level pulse corresponds to the fourth time; and wherein the fourth time is after the third time, and one of the unit times is between the third and fourth times.

* * * * *